US007744434B2

(12) United States Patent
Wu

(10) Patent No.: US 7,744,434 B2
(45) Date of Patent: Jun. 29, 2010

(54) OSCILLATING-FOIL TYPE UNDERWATER PROPULSOR WITH A JOINT

(75) Inventor: Chun-Kai Wu, Tainan (TW)

(73) Assignee: Chang Jung Christian University (TW)

( * ) Notice: Subject to any disclaimer, the term of this patent is extended or adjusted under 35 U.S.C. 154(b) by 2 days.

(21) Appl. No.: 12/287,526

(22) Filed: Oct. 9, 2008

(65) Prior Publication Data

US 2009/0191772 A1 Jul. 30, 2009

(30) Foreign Application Priority Data

Jan. 24, 2008 (TW) ..... 97102611 A

(51) Int. Cl.
*B63H 1/36* (2006.01)

(52) U.S. Cl. ..... 440/14; 440/21

(58) Field of Classification Search ..... 440/13, 440/14, 21; 441/61, 62, 63, 64
See application file for complete search history.

(56) References Cited

U.S. PATENT DOCUMENTS 3,833,956 A * 9/1974 Meehan ..... 440/14
4,025,977 A * 5/1977 Cronin ..... 441/64
4,102,293 A * 7/1978 de la Roche Kerandraon 440/13
4,767,368 A * 8/1988 Ciccotelli ..... 441/64
5,401,196 A * 3/1995 Triantafyllou et al. ..... 440/13
7,198,529 B2 * 4/2007 Cleary ..... 440/21

* cited by examiner

*Primary Examiner*—Lars A Olson
(74) *Attorney, Agent, or Firm*—Martine Penilla & Gencarella LLP

(57) ABSTRACT

An oscillating-foil type underwater propulsor with a joint provided in the invention, the propulsor including a streamline foil having a foil surface being parallel to a water surface and a span length of at least twice as long as an average chord length of the streamline foil, and a heaving mechanism undergoing heaving motion perpendicular to a propulsion direction of the propulsor and having a transmission section, wherein the transmission section is pivotally connected to the streamline foil to form a joint, the joint being provided at the middle of the span length and having a rotation center located within a circular area, which has a radius of one third of the average chord length and is centered at the point one third of the average chord length ahead of the lifting center of the streamline foil.

15 Claims, 8 Drawing Sheets

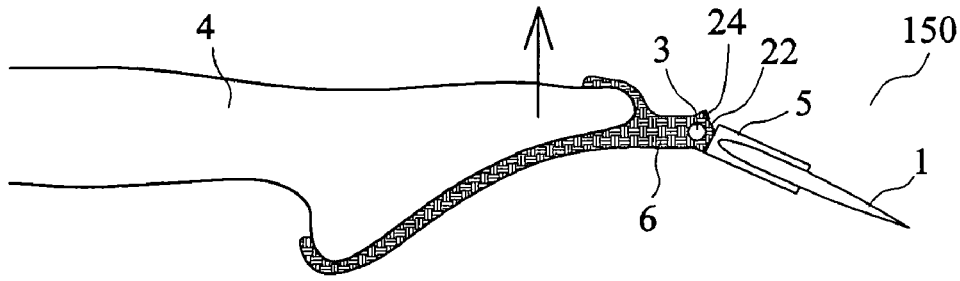
FIG. 3A
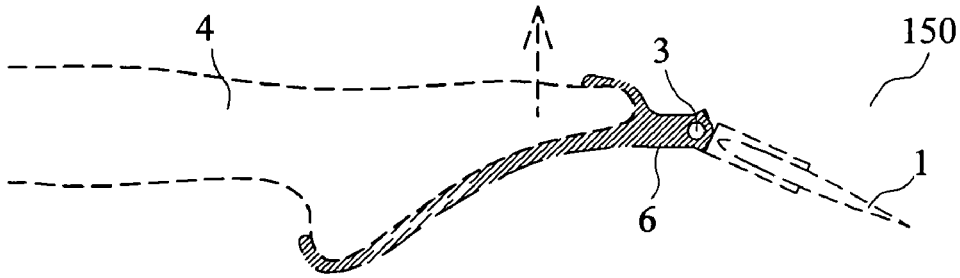
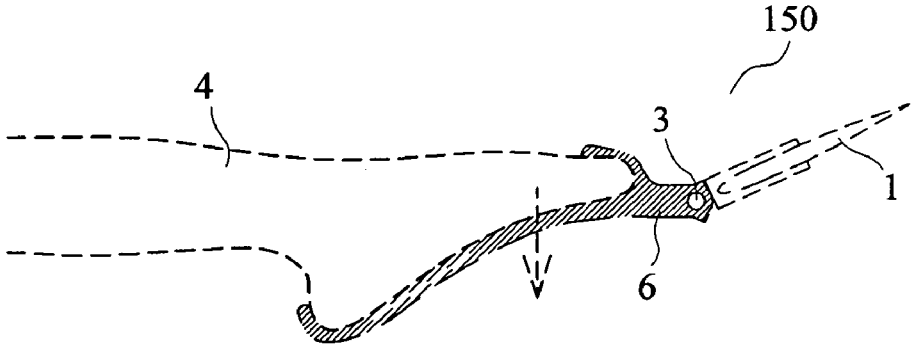
FIG. 3B
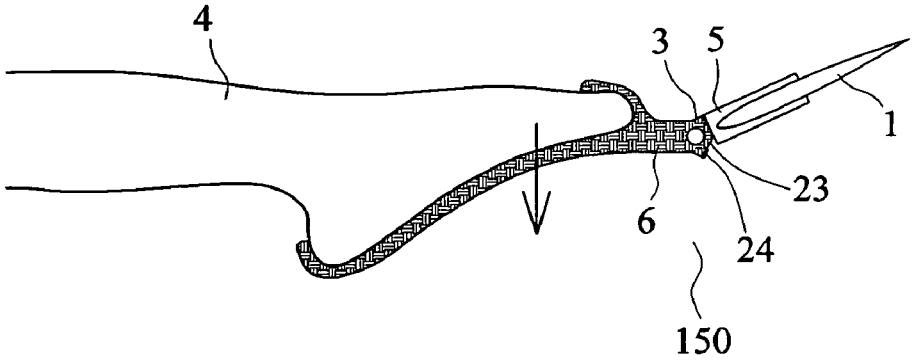

OSCILLATING-FOIL TYPE UNDERWATER PROPULSOR WITH A JOINT

BACKGROUND OF THE INVENTION

1. Field of the Invention

The invention relates generally to an underwater propulsor, in particular to an oscillating-foil type underwater propulsor with a joint. The underwater propulsor of the invention mimics the tail movement of fast moving cetaceans or tunas and provides an oscillating foil and a joint for achieving better propulsion efficiency.

2. Description of Related Art

Regarding conventional underwater propulsors, there are a variety of applications such as flippers for diving or snorkeling, paddles for canoeing or Chinese dragon boats, and propellers of container ships or ocean liners. As an auxiliary equipment to facilitate propulsion, the flippers have long been important in the history of human underwater activities. Such a flipper has an appearance resembling the webbed toes of a frog, but it actually functions like a tail fin of slow moving fish. For a flat structure such as the flipper, the flat structure can easily cause early flow separation and stall when used as a propulsor in a fluid medium because it does not have a thicker foil thickness and a larger curvature radius of the leading edge of a high performance streamline foil, making it an inferior device for providing lift and taking load. Besides, the flipper also is a soft or non-rigid structure, which is prone to deformation and unable to take or transmit a larger thrust. Therefore, the flipper produces a very limited thrust in practical use.

The main propulsion method used in ships today is by the use of propellers. The marine main engine transfers the kinetic power through a shaft to the propeller, the blades of which then rotate to push the water backwards to generate a forward thrust, so that the ship is propelled. During the rotation of the fins, however, water surrounding the fins travels in a circumferential direction, which is almost helpless in facilitating the propulsion of the ship and becomes energy loss. For a conventional screw propeller, this problem has been a major barrier to further significant improvement of propulsion efficiency.

Furthermore, the screw propeller has another disadvantage, which is low maneuverability. When the mechanical power of the marine main engine is transferred to the propeller through the shaft fixed to the hull of the ship, the direction of the thrust produced by the propeller may not be controlled due to the fixed-positioned shaft. Therefore, the propeller by itself can only produce forward and backward thrusts but not side thrusts. A rudder is usually provided to change the direction of the water passing through the propeller to produce the side thrust needed. However, the rudder is only functional when the ship is going forward or backward, and that the side thrust is only a small fraction of the total thrust produced by the propeller, thus the ship can not be flexibly handled to move in the desired direction. To enhance the ship's maneuverability, a podded propulsor has been invented and developed for various applications in recent years. The podded propulsor resembles a small-scale submarine and has an advantage of being capable of rotating 360 degrees to overcome the steering problem. However, the propulsion method of the podded propulsor is the same as that of the propeller in that both types of propulsors use rotating blades and thus cause rotational kinetic energy loss. The propulsion method therefore has to be improved in order to enhance propulsion efficiency.

To solve the problems above, the invention provides a general-use underwater propulsor for various purposes.

BRIEF SUMMARY OF THE INVENTION

The invention relates to an oscillating-foil type underwater propulsor with a joint. The underwater propulsor of the invention mimics the tail movement of fast moving cetaceans or tunas and improves the propulsion efficiency and maneuverability of the propulsor, the propulsor being a general-use underwater propulsion device that can be used on a human body, a yacht or a cargo ship.

According to one embodiment of the invention, an oscillating-foil type underwater propulsor with a joint is provided, the propulsor including a streamline foil having a foil surface being parallel to a water surface and a span length of at least twice as long as an average chord length of the streamline foil; and a heaving mechanism undergoing heaving motion perpendicular to the direction of the span and a propulsion direction of the propulsor and having a transmission section, wherein the transmission section is pivotally connected to the streamline foil to form a joint, the joint being provided at the middle of the span length of the streamline foil and having a rotation center located within a circular area, which has a radius of one third of the average chord length and is centered at the point one third of the average chord length ahead of the lifting center of the streamline foil. The heaving mechanism includes a rotational cylinder being hollow inside and having an opening at the bottom, the rotational cylinder being configured as a body of the heaving mechanism; a first permanent magnet provided around the top of the inside of the rotational cylinder; a second permanent magnet provided around the bottom of the inside of the rotational cylinder; a coil provided around the inside of the rotational cylinder and between the first permanent magnet and the second permanent magnet; and a third permanent magnet provided inside the coil and having a bottom attached to the transmission section. The coil can have an electric current passing through it to induce a magnetic field, the direction of the magnetic field is alternated by alternating the direction of the electric current to enable the third permanent magnet to undergo reciprocal heaving motion so as to actuate the transmission section. In addition, the heaving mechanism further includes a plurality of rollers provided inside the rotational cylinder between the opening and the second permanent magnet to facilitate reciprocal heaving motion of the transmission section. Furthermore, the transmission section has an upper limiter and a lower limiter located on the surface of the end that is pivotally connected to the streamline foil, the upper limiter being configured for limiting counterclockwise rotation of the streamline foil and the lower limiter being configured for limiting clockwise rotation of the streamline foil so that the streamline foil rotates within an angle between about +30 degrees and about −30 degrees. Each of the upper limiter and the lower limiter can have a buffer pad for reducing impact on the transmission section caused by heaving motion of the streamline foil. Moreover, the propulsor of the embodiment further includes a turntable provided on the outside of the rotational cylinder, and a support for supporting the turntable, the support having at least one track. The turntable is engaged with the at least one track to allow the propulsor to rotate 360 degrees so as to change the propulsion direction.

According to another embodiment of the invention, an oscillating-foil type underwater propulsor with a joint used on a human body is provided, the propulsor including a streamline foil having a foil surface being parallel to the front of the human body and having a span length of at least twice as long as an average chord length of the streamline foil, and a foot pocket for accommodating a foot of the human body, wherein the foot pocket is pivotally connected to the streamline foil to form a joint, the joint being provided at the middle of the span length and having a rotation center located within a circular area, which has a radius of one third of the average chord length and is centered at the point one third of the average chord length ahead of the lifting center of the streamline foil.

According to yet another embodiment of the invention, an oscillating-foil type underwater propulsor with a joint for a man-powered watercraft is provided, the propulsor including a streamline foil having a foil surface being parallel to a water surface and a span length of at least twice as long as an average chord length of the streamline foil; a transmission rod having a grip on its top; and a holder being hollow inside and holding the transmission rod in it, wherein the transmission rod is pivotally connected to the streamline foil to form a joint, the joint being provided at the middle of the span length of the streamline foil and having a rotation center located within a circular area, which has a radius of one third of the average chord length and is centered at the point one third of the average chord length ahead of the lifting center of the streamline foil. The propulsor of the embodiment further includes an upper stopper provided at the bottom of the grip to limit downward movement of the transmission rod, and a lower stopper provided on the transmission rod below the holder to limit upward movement of the transmission rod so as to prevent the streamline foil from hitting the hull of the watercraft. In addition, the transmission rod is capable of rotating 360 degrees so as to change the propulsion direction.

BRIEF DESCRIPTION OF THE DRAWINGS

The invention will be more readily understood with the detailed description below in reference to the accompanied drawings, in which like numeral references denote like elements.

FIG. 3A is a schematic side view of an oscillating-foil type underwater propulsor with a joint used on a human body showing the state of the propulsor when the human foot is kicking up according to the embodiment of the invention.

FIG. 3B shows the state of the propulsor when the human foot in FIG. 3A is kicking down.

DETAILED DESCRIPTION OF THE INVENTION

To increase the propulsion efficiency and maneuverability of a moving underwater object or a floating body, the invention has the following improvements.

1. Underwater Propulsion by Use of an Oscillating Foil

The invention provides a streamline foil undergoing heaving motion and pitch variation to mimic tail movement of a cetacean swimming at high speed. The oscillating foil pushes water backwards to gain a forward thrust. Thus, propelling in this way avoids rotational energy loss associated with rotating motion of a conventional screw propeller. This type of propulsion has a higher propulsion efficiency than that of a screw propeller.

2. Foil Pitch Control with a Joint

To obtain an effective thrust, a foil undergoing heaving motion needs to have appropriate pitch angle variation associated with the motion. The invention provides an underwater joint that enables the foil pitch angle to be self-adjusted by using the variation of fluid dynamic lift acting on the foil and the change of lift direction during the heaving motion. The foil can thus reach its performance at a correct inflow angle of attack during the heaving motion. The joint is simple enough and can be adopted to replace complex mechanism conventionally used for pitch angle control of an oscillating foil.

3. Reciprocal Motion

The heaving motion of the invention is a reciprocating motion in which there is transverse displacement in the direction of motion. It is apparently similar to the motion of moving piston of an internal combustion engine. However, the reciprocating motion of the invention is intrinsically different from the rotating-driving movement of an electric motor. Moreover, as for paddling a canoe or kicking in swimming or diving, the reciprocating motion can be more naturally performed and is effort-saving and ergonomical.

4. Thrust in 360 Degrees

As compared to a conventional underwater propulsor, the underwater propulsor of the invention uses a steering axle system that is fully adjustable according to the desired propulsion direction. This enhances the maneuverability of the ship so as to propel the ship forward, backward, or sideways.

The embodiments of the invention will now be explained below in reference to the accompanied drawings.

Figure 1A:
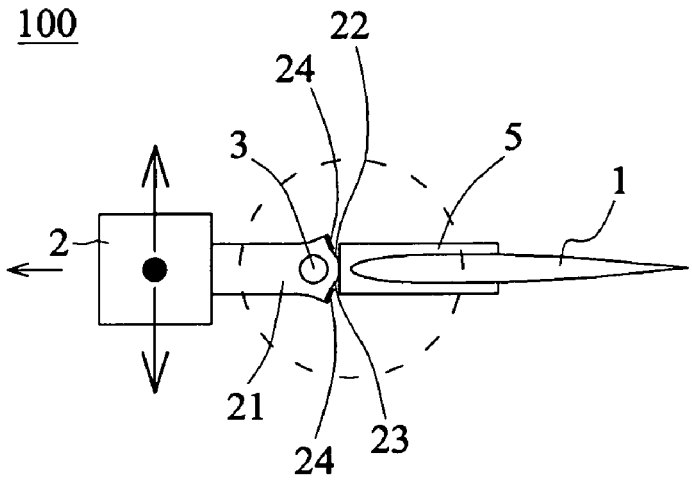
FIG. 1A is a schematic side view showing an oscillating-foil type underwater propulsor with a joint according to an embodiment of the invention.
Figure 1B:
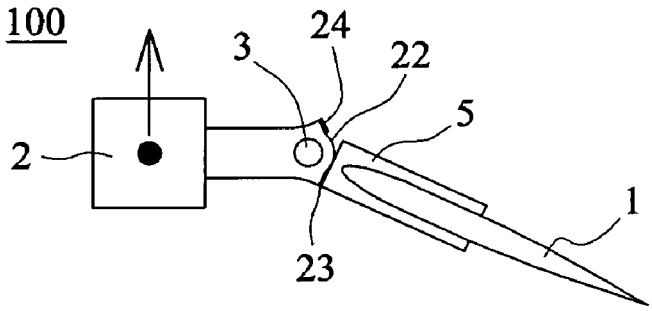
FIG. 1B shows the state of the propulsor when the heaving mechanism is heaving up according to the embodiment of the invention.
Figure 1C:
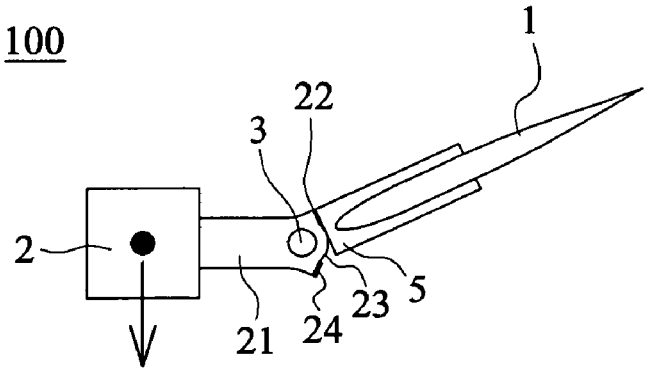
FIG. 1C shows the state of the propulsor when the heaving mechanism is heaving down according to the embodiment of the invention.
Figure 1D:
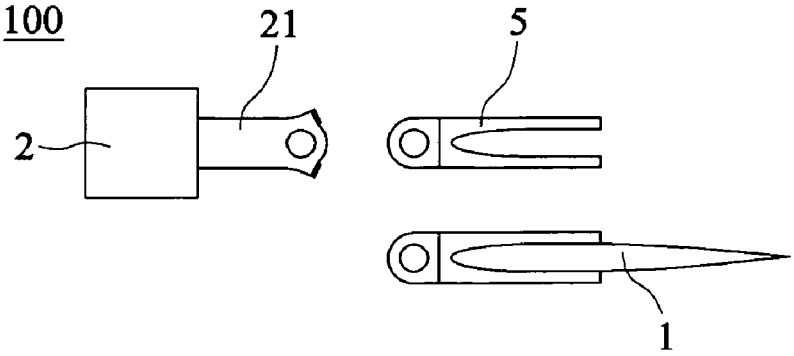
FIG. 1D shows a schematic assembling diagram of an oscillating-foil type underwater propulsor with a joint according to an embodiment of the invention.
Figure 2:
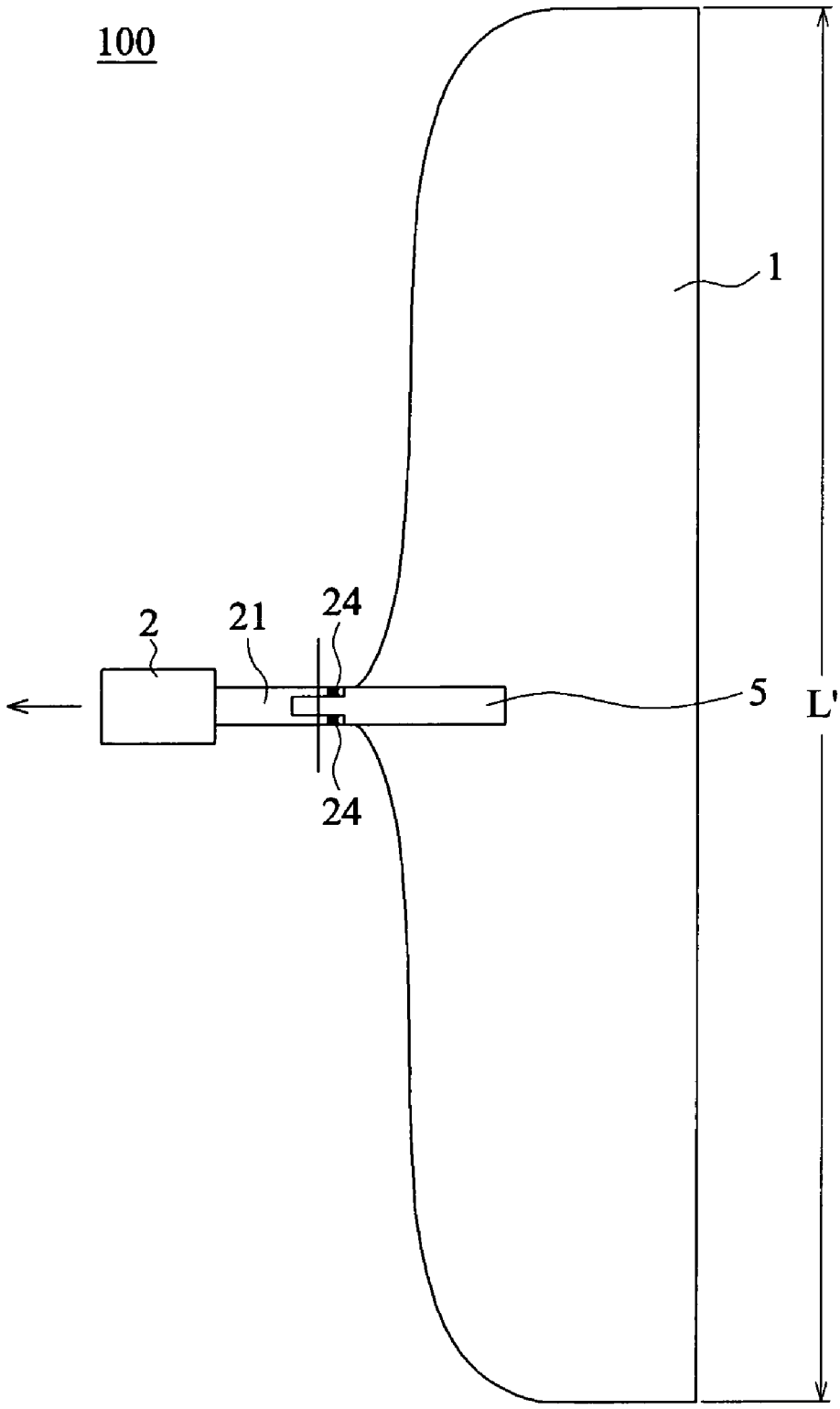
FIG. 2 is a top view of the propulsor in FIG. 1A.

FIG. 1A is a schematic side view of an oscillating-foil type underwater propulsor 100 having a joint according to one embodiment of the invention, and FIG. 2 is a top view of the underwater propulsor 100 shown in FIG. 1A. As shown in FIGS. 1A and 2, the propulsor 100 includes: a streamline foil 1 having a span length (indicated as L' in FIG. 2) provided as being perpendicular to a propulsion direction (indicated as the left-pointing arrow in FIG. 2) of the propulsor and being at least twice as long as an average chord length of the streamline foil; a heaving mechanism 2 undergoing heaving motion (in the direction of the up and down arrows in FIG. 1A) that is perpendicular to the propulsion direction (the left-pointing arrow in FIG. 1A) and having a transmission section 21; and a connection section 5 being attached to the streamline foil 1. The average chord length is defined as the foil's projected area divided by the span length, and the foil's projected area is obtained by integrating the chord length along the span direction. The transmission section 21 is pivotally connected to the connection section 5 to form a joint 3, and the joint 3 is disposed at the middle of the span length of the streamline foil 1. The rotation center of the joint 3 is located within a circular area, which has a radius of one third of the average chord length and is centered at the point one third of the average chord length ahead of the lifting center of the streamline foil, i.e. the rotation center of the joint 3 lies inside the dotted circle shown in FIG. 1A, the circle being formed by the radius thereof. If the rotation center of the joint 3 is located on the foil 1 at a point downstream the lifting center of the streamline foil, the streamline foil 1 will be unable to heave to a proper pitch angle during oscillation, which renders the propulsion ineffective. On the other hand, if the rotation center of the joint 3 is not located on the foil 1 but at a point towards the heaving mechanism 2 at a distance of more than two third of the average chord length from the lifting center, the streamline foil 1 will have to undergo a considerable transverse displacement in the direction of oscillation to heave to a proper pitch angle during oscillation. The transverse displacement of the foil will have to be compensated by the displacement of the heaving mechanism 2, and the propulsion efficiency is thus significantly reduced. According to the embodiment of the invention, the rotation center of the joint 3 can be provided within a range determined by the following steps: integrating the chord length along the span direction and dividing the integration result by the span length to define the average chord length; defining the center of lift, which is the point where the lift passes through, and which is normally located at a distance of one third of the average chord length from the leading edge; and defining the range in which the rotation center of the joint 3 is located is a circular area, which has a radius of one third of the average chord length and is centered at the point one third of the average chord length ahead of the lifting center of the streamline foil. In another embodiment of the invention, the streamline foil 1 and the connection section 5 are integrally formed in one piece, i.e., the transmission section 21 is directly pivoted to the streamline foil 1. Additionally, the streamline foil 1 is made of rigid materials so that the thrust can be well delivered and the propulsion efficiency can be enhanced without the risk of deformation. As shown in FIG. 1A, the reciprocating motion of the heaving mechanism 2 oscillates in the transverse direction perpendicular to the direction of propulsion (the left-pointing arrow). With the transmission section 21 actuating the connection section 5 attached to the streamline foil 1, the streamline foil 1 undergoes heaving motion reciprocally. Additionally, the transmission section 21 has an upper limiter 22 and a lower limiter 23 located on the surface of the end that is pivotally connected to the streamline foil 1 or the connection section 5. The upper limiter 22 is used to limit the counterclockwise rotation of the streamline foil 1 and the connection section 5, and the lower limiter 23 is used to limit the clockwise rotation of the streamline foil 1 and the connection section 5, so that the streamline foil 1 and the connection section 5 rotates within an angle of between about +30° and about −30° (relative to the propulsion direction, for example). Moreover, a buffer pad 24 is provided on each of the upper limiter 22 and the lower limiter 23 to reduce the impact on the transmission section 21 caused by the oscillating streamline foil 1 and connection section 5. FIG. 1B shows the propulsor 100 in which the heaving mechanism 2 heaves upwards, and FIG. 1C shows the propulsor 100 in which the heaving mechanism 2 heaves downwards. FIG. 1D shows an assembling diagram of the oscillating-foil type underwater propulsor 100 with a joint according to the embodiment of the invention. As in FIG. 1D, the transmission section 21 can either be pivotally connected to the streamline foil 1 or the connection section 5.

Although the streamline foil in FIG. 2 is shown as rectangular, it should be noted that persons skilled in the art can implement a streamline foil as being any symmetrical or asymmetrical shape.

FIG. 3A is a schematic side view showing an oscillating-foil type underwater propulsor 150 with a joint used on a human body according to one embodiment of the invention. It shows the state of the propulsor 150 when the leg of a human heaves up (i.e. kicks upwards/forth). FIG. 3B shows the state of the propulsor 150 when the leg in FIG. 3A heaves down (i.e. kicks downwards/back). As shown in FIGS. 3A and 3B, the propulsor 150 includes a streamline foil 1 having a foil surface being parallel to the front of the human body and a span length of at least twice as long as the average chord length; a connection section 5 for fixing the streamline foil 1; and a foot pocket 6 for accommodating the human foot. A joint 3 is formed by pivotally connecting the foot pocket 6 to the connection section 5. The joint 3 is provided at the middle of the span length of the streamline foil 1, and the rotation center of the joint 3 is located within a circular area, which has a radius of one third of the average chord length and is centered at the point one third of the average chord length ahead of the lifting center of the streamline foil 1, i.e. inside the dotted circle shown in FIG. 1A. In another embodiment of the invention, the streamline foil 1 is integrally formed with the connection section 5 in one piece, i.e., the streamline foil 1 is directly in pivotal connection to the foot pocket 6. Additionally, the streamline foil 1 is made of rigid materials so that the thrust can be well delivered and the propulsion efficiency can be enhanced without the risk of deformation. The propulsor 150 is similar to the propulsor 100 shown in FIG. 1 in that the foot pocket 6 pivotally connected to the streamline foil 1 or the connection section 5 has an upper limiter 22 and a lower limiter 23 located on the surface of one end as similarly shown in FIG. 1. The upper limiter 22 is used to limit the counterclockwise rotation of the streamline foil 1 and the connection section 5, and the lower limiter 23 is used to limit the clockwise rotation of the streamline foil 1 and the connection section 5, so that the streamline foil 1 and the connection section 5 rotates within an angle of between about +30° and about −30°. Moreover, a buffer pad 24 is provided on each of the upper limiter 22 and the lower limiter 23 to reduce the impact on the foot pocket 6 caused by the oscillating streamline foil 1 and connection section 5.

Figure 4A:
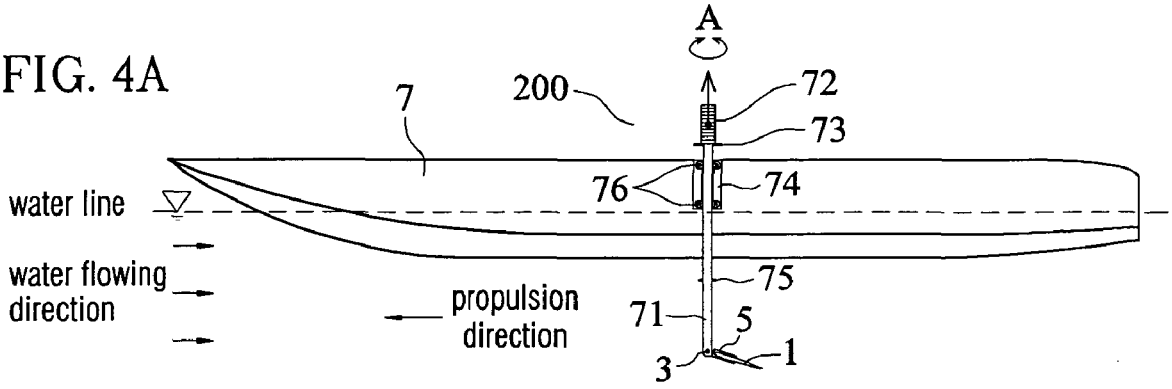
FIG. 4A is a schematic side view of an oscillating-foil type underwater propulsor with a joint for a man-powered watercraft showing the state of the propulsor when the transmission rod is heaving up according to the embodiment of the invention.
Figure 4B:
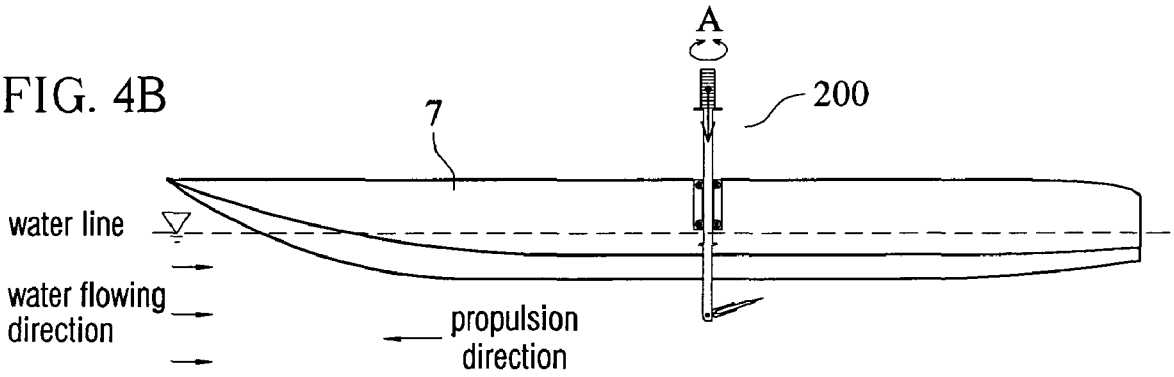
FIG. 4B shows the state of the propulsor when the transmission rod in FIG. 4A is heaving down.
Figure 4C:
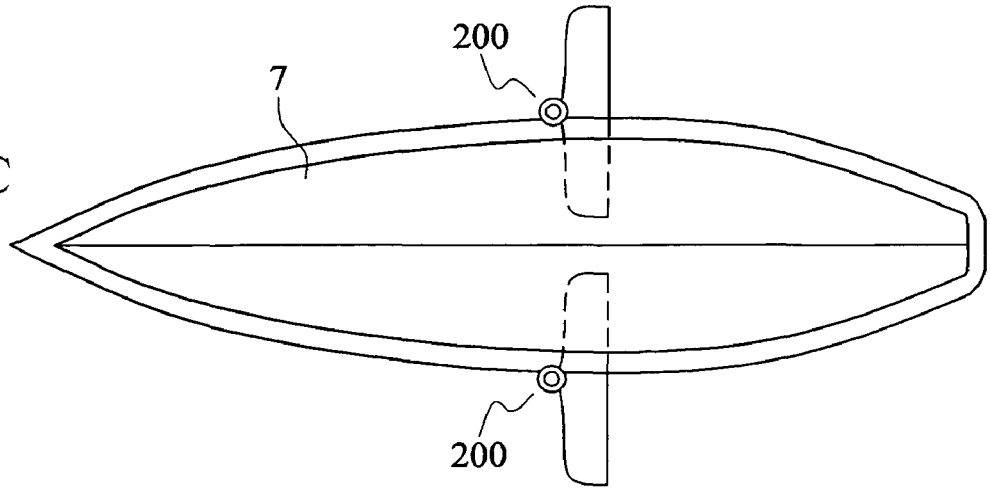
FIG. 4C is a top view of the propulsor in FIG. 4A showing the fixing position of the propulsor(s).

FIG. 4A is a schematic side view of an oscillating-foil type underwater propulsor 200 with a joint used on a canoe 7 according to one embodiment of the invention. It shows the state of the propulsor 200 when a transmission rod 71 is heaving up. FIG. 4B shows the state of the propulsor 200 of FIG. 4A when the transmission rod 72 is heaving down. As shown in FIGS. 4A and 4B, the propulsor 200 includes a streamline foil 1 having a foil surface being parallel to a water surface and a span length of at least twice as long as the average chord length; a connection section 5 for fixing the streamline foil 1; a transmission rod 71, the top of which has a grip 72, the grip 72 having an upper stopper 73 at the lower end to limit the heaving motion of the transmission rod 71; a holder 74 being hollow inside and holding the transmission rod 71 in it; a lower stopper 75 fixed to the transmission rob 71 below the holder 74 to prevent the streamline foil 1 from hitting the canoe hull when the transmission rod 71 heaves up; and a plurality of rollers 76 provided between the holder 74 and the transmission rod 71 to facilitate the up-and-down reciprocal motion of the transmission rod 71. The transmission rod 71 is pivotally connected to the connection section 5 to form a joint 3. The joint 3 is provided at the middle of the span of the streamline foil 1, and the rotation center of the joint 3 is located within a circular area, which has a radius of one third of the average chord length and is centered at the point one third of the average chord length ahead of the lifting center of the streamline foil 1. In another embodiment of the invention, the connection section 5 and the streamline foil 1 are integrally formed in one piece, i.e., the transmission rod 71 is directly in pivotal connection to the streamline foil 1. Additionally, the streamline foil 1 is made of rigid materials so that the thrust can be well delivered and the propulsion efficiency can be enhanced without the risk of deformation. For illustrative purposes, the propulsor 200 does not show the upper limiter 22 and the lower limiter 23 as shown in FIG. 1, but it can indeed have the upper limiter 22 and the lower limiter 23 as shown in FIG. 1 to limit the up-and-down heaving motion of the connection section 5 and streamline foil 1. Moreover, a buffer pad 24 can be provided on each of the upper limiter 22 and the lower limiter 23 to reduce the impact on the transmission rod 71 caused by the oscillating connection section 5 and streamline foil 1. Furthermore, the transmission rod 71 can rotate 360 degrees axially, as indicated by arrows A in FIGS. 4A and 4B. FIG. 4C is a top view of the propulsor 200 in FIG. 4A, showing the location at which the propulsor(s) 200 is disposed.

Figure 5A:
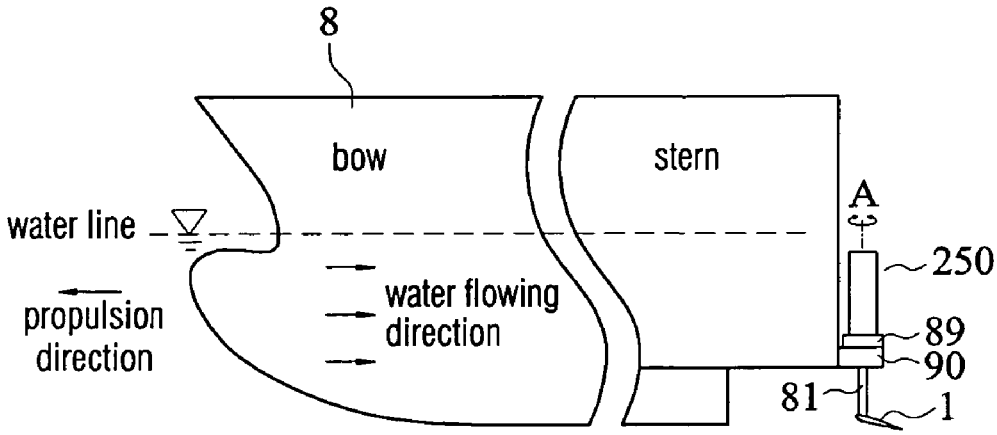
FIG. 5A illustrates an oscillating-foil type underwater propulsor with a joint fixing to a ship according to one embodiment of the invention.
Figure 5B:
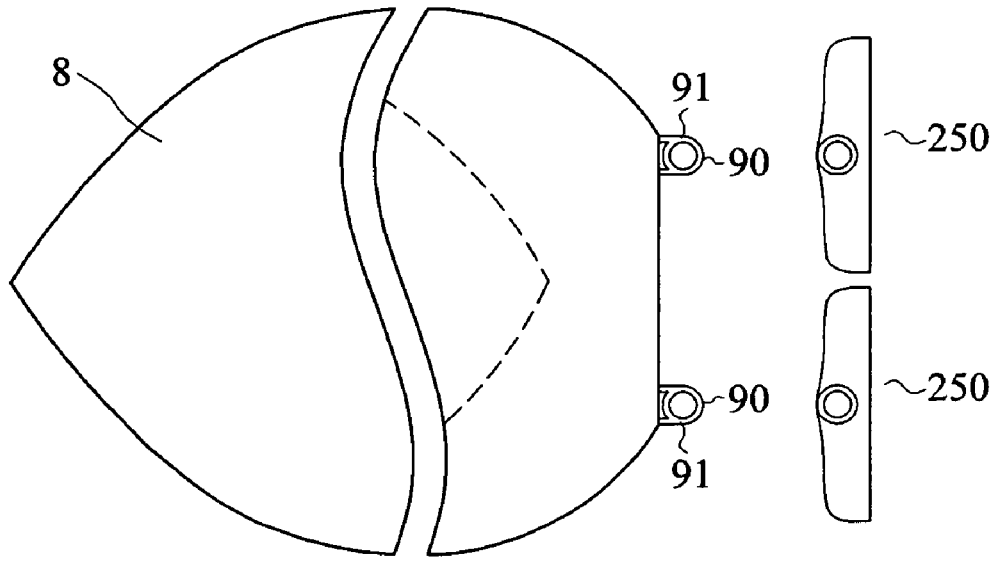
FIG. 5B is a top view of the propulsor(s) fixed to the ship in FIG. 5A.
Figure 5C:
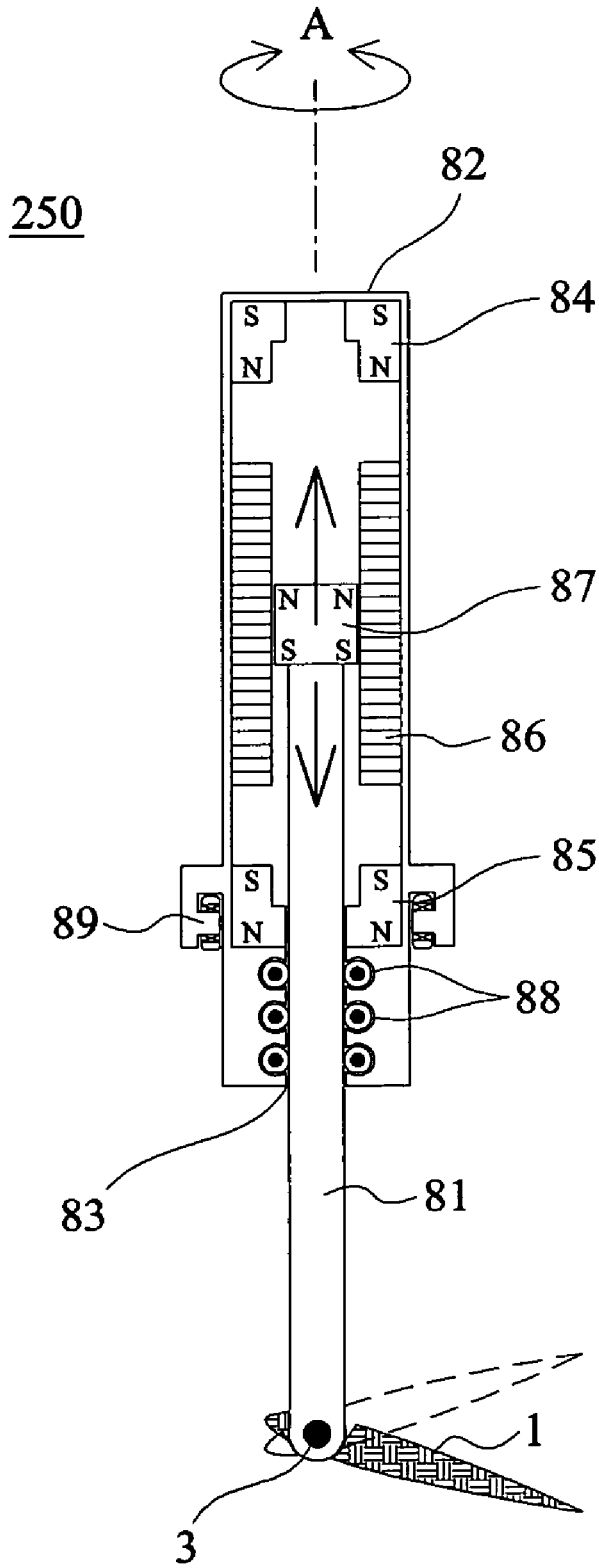
FIG. 5C shows an enlarged cross-sectional view of the propulsor in FIG. 5A.

FIG. 5A shows an oscillating-foil type underwater propulsor 250 with a joint used on a ship 8 according to one embodiment of the invention. FIG. 5B is a top view of the propulsor 250 in FIG. 5A. FIG. 5C is an enlarged cross-sectional view of the propulsor 250 in FIG. 5A. As shown in FIGS. 5A, 5B, and 5C, the propulsor 250 includes a streamline foil 1 having a foil surface being parallel to a water surface and a span length of at least twice as long as the average chord length; a transmission rod 81; a rotational cylinder 82 being hollow inside and holding the transmission rod 81 in it and having an opening 83 at the bottom of the cylinder with the transmission rod 81 provided through the opening 83 to be pivotally connected to the streamline foil 1; a first permanent magnet 84 provided around the top of the inside of the rotational cylinder; a second permanent magnet 85 provided around the bottom of the inside of the rotational cylinder; a coil 86 provided between the first permanent magnet 84 and the second permanent magnet 85 and around the inside of the rotational cylinder; a third permanent magnet 87 provided inside the coil and having one end connected to the transmission rod 81; a plurality of rollers 88 provided inside the rotational cylinder 82 and between the opening 83 and the second permanent magnet 85 to facilitate the up-and-down reciprocal motion of the transmission rod 81; a turntable 89 provided on the outside of the rotational cylinder 82; and a support 90 having a track 91 and being attached to the ship to support the turntable 89. The turntable 89 engages with the track 91 so that the propulsor 250 can rotate 360 degrees in the direction shown by the arrow A in FIG. 5A to change the propulsion direction. However, it is apparent to persons skilled in the art that the streamline foil 1 of the propulsor 250 should not be allowed to contact with the ship hull when the propulsor 250 is making a 360-degree turn. Moreover, the transmission rod 81 is pivotally connected to the streamline foil 1 to form a joint 3. The joint 3 is positioned at the middle of the span length and has its rotation center located within a circular area, which has a radius of one third of the average chord length and is centered at the point one third of the average chord length ahead of the lifting center of the streamline foil 1. In this embodiment, the connection section 5 shown in FIG. 1 and the streamline foil 1 are integrally formed in one-piece, so that only the streamline foil 1 is shown. Additionally, the streamline foil 1 is made of rigid materials so as to well deliver the thrust and increase the propulsion efficiency without the risk of deformation. For illustrative purposes, the propulsor 250 does not show the upper limiter 22 and the lower limiter 23 as shown in FIG. 1, but it can indeed have the upper limiter 22 and the lower limiter 23 shown in FIG. 1 to limit the up-and-down heaving motion of the streamline foil 1. Moreover, a buffer pad 24 can be provided on each of the upper limiter 22 and the lower limiter 23 to reduce the impact on the transmission rod 81 caused by the oscillating streamline foil 1. Also in the embodiment shown in FIG. 5B, the ship 8 uses twin propulsors which are positioned side by side, i.e., behind the stern as a starboard propulsor and a port propulsor respectively.

For the coil 86, an electric current can be applied to pass through part of the coil to induce a magnetic field, the direction of which can be changed by changing the direction of the electric current, so by continuously changing or alternating the current direction the third permanent magnet 87 undergoes up-and-down reciprocal motion to drive the transmission rod 81. Two repulsive forces of varying magnitude respectively exist between the moving third permanent magnet 87 and the first permanent magnet 84 and between the moving third permanent magnet 87 and the second permanent magnet 85, and the magnitudes of the repulsive forces vary as the distances between the magnets change. These repulsive forces result in storage and release of the magnetic energy, which is used to improve the efficiency for converting the electric energy (as input) to mechanical energy (as output). Specifically, since power equals the multiplication of instant force and instant speed, it is preferable to supply electric energy to do work on the streamline foil 1 when the instant speed of the oscillating streamline foil 1 is high. On the other hand, it is preferable to release the stored energy due to magnetic repulsive force when the instant speed of the oscillating streamline foil 1 is low.

Moreover, to adjust the vertical position of the streamline foil 1 relative to the hull, one just has to raise or lower the first permanent magnet 84, the second permanent magnet 85, and the coil 86 all together vertically. Furthermore, to adjust the oscillation amplitude of the streamline foil 1, one just has to move the first permanent magnet 84 and the second permanent magnet 85 vertically in opposite direction.

Figure 6A:
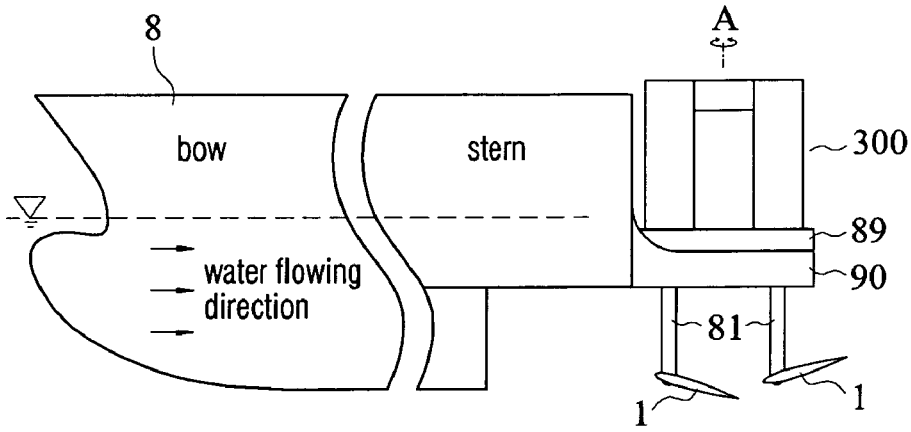
FIG. 6A illustrates an oscillating-foil type underwater propulsor with joints (two constituent propulsors) fixing to a ship according to another embodiment of the invention.
Figure 6B:
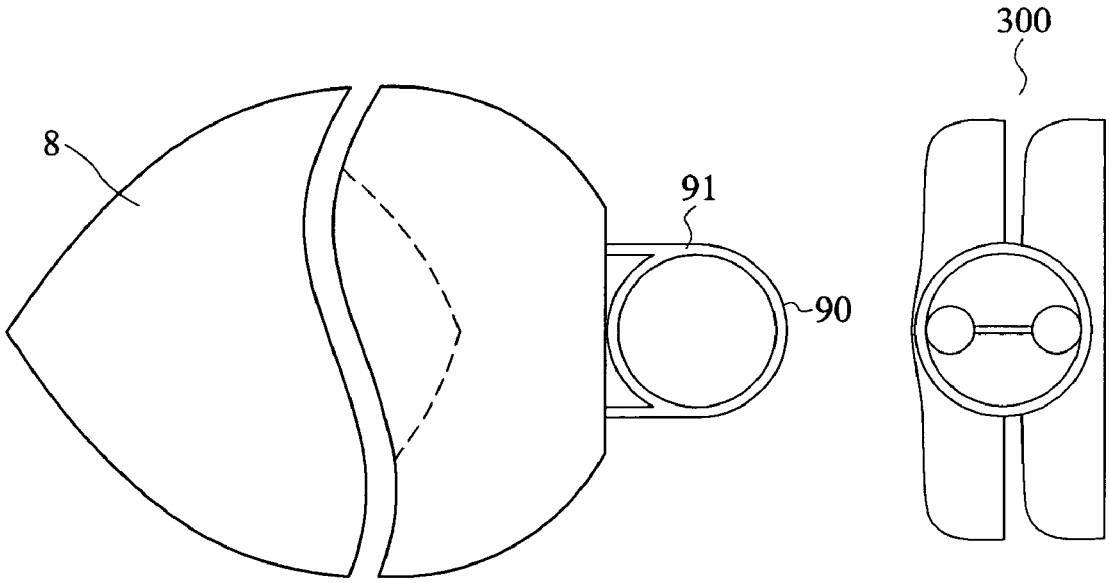
FIG. 6B is a top view of the propulsor(s) in FIG. 6A.
Figure 6C:
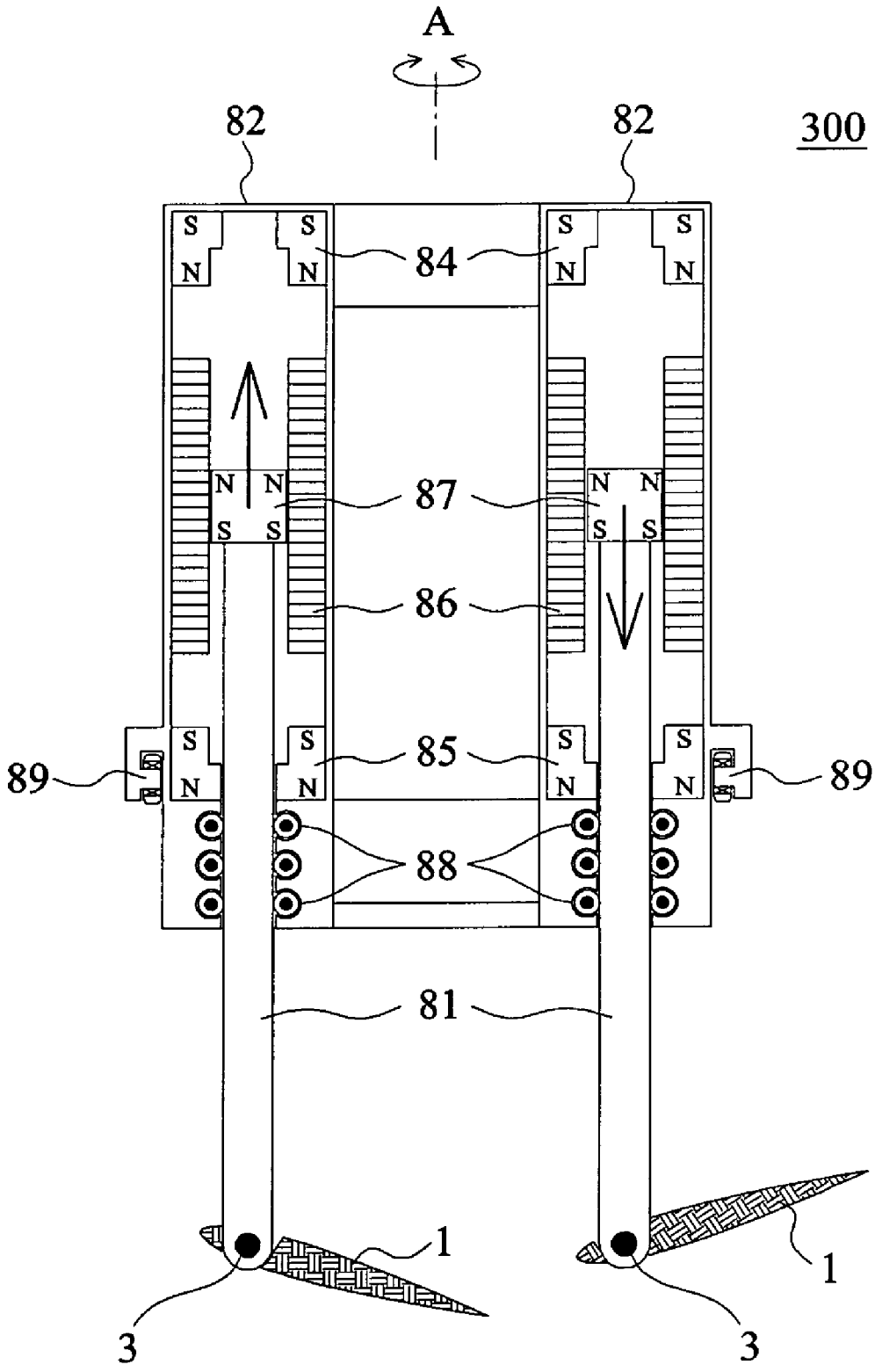
FIG. 6C shows an enlarged cross-sectional view of the propulsor in FIG. 6A

FIG. 6A shows an oscillating-foil type underwater propulsor 300 with a joint used on a ship 8 according to another embodiment of the invention. FIG. 6B is a top view of the propulsor 300 in FIG. 6A. FIG. 6C shows an enlarged cross-sectional view of the propulsor 300 in FIG. 6A. As shown in FIGS. 6A and 6C, the propulsor 300 is similar to the propulsor 250 but different in that the propulsor 300 is a combination of the two constituent propulsors 250. In the propulsor 300, the foil of one constituent propulsor heaves up while the foil of the other constituent propulsor heaves down so that the up and down forces of the oscillation balance out. In this embodiment as shown in FIG. 6B, the propulsor 300 is configured as twin propulsors positioned in tandem, i.e., the two constituent propulsors are positioned one after the other behind the stem of the ship 8. Moreover, a turntable 89 is provided on the outside of constituent propulsors, and a support 90 is provided with a track 91 and is attached to the ship to support the turntable 89. The turntable 89 engages with the track 91 so that the propulsor 300 can rotate 360 degrees in the direction shown by the arrow A in FIG. 6C to change the propulsion direction. Due to the fact that the propulsor 300 is a combination of two constituent propulsors, the constituent propulsors rotate in synchrony as the propulsor 300 rotates. It should be apparent to persons skilled in the art that the streamline foil 1 is designed to avoid contacting with the hull when the propulsor 300 rotates in 360 degrees.

While the invention has been shown and described with reference to a preferred embodiment thereof, and in terms of the illustrative drawings, it should not be considered as limited thereby. Various possible modifications, omissions, and alterations could be conceived of by one skilled in the art to the form and the content of any particular embodiment, without departing from the scope of the invention.

What is claimed is:

1. An oscillating-foil type underwater propulsor with a joint, the propulsor comprising:

a streamline foil having a foil surface being parallel to a water surface and a span length of at least twice as long as an average chord length of the streamline foil; and a heaving mechanism undergoing heaving motion perpendicular to a propulsion direction of the propulsor and having a transmission section, the heaving mechanism comprising: a rotational cylinder being hollow inside and having an opening at the bottom, the rotational cylinder being configured as a body of the heaving mechanism; a first permanent magnet provided around the top of the inside of the rotational cylinder; a second permanent magnet provided around the bottom of the inside of the rotational cylinder; a coil provided around the inside of the rotational cylinder and between the first permanent magnet and the second permanent magnet; and a third permanent magnet provided inside the coil and having a bottom attached to the transmission section, wherein the transmission section is configured to extend outwards from the opening to pivotally connect the streamline foil, wherein the transmission section is pivotally connected to the streamline foil to form a joint, the joint being provided at the middle of the span length and having a rotation center located within a circular area, which has a radius of one third of the average chord length and is centered at a point one third of the average chord length ahead of a lifting center of the streamline foil.

2. The propulsor of claim 1, wherein the coil has an electric current passing through it to induce a magnetic field, the direction of the magnetic field is alternated by alternating the direction of the electric current to enable the third permanent magnet to undergo reciprocal heaving motion so as to actuate the transmission section.

3. The propulsor of claim 1, wherein the streamline foil is made of rigid materials.

4. The propulsor of claim 1, wherein the first permanent magnet, the second permanent magnet, and the coil are simultaneously adjusted up or down in the rotational cylinder so as to adjust vertically the center of heaving motion of the streamline foil.

5. The propulsor of claim 1, wherein the first permanent magnet and the second permanent magnet are adjusted vertically in opposite direction so as to adjust the amplitude of heaving motion of the streamline foil.

6. The propulsor of claim 1, further comprising:

a plurality of rollers provided inside the rotational cylinder between the opening and the second permanent magnet to facilitate reciprocal heaving motion of the transmission section.

7. The propulsor of claim 1, further comprising:

a turntable provided on the outside of the rotational cylinder; and a support for supporting the turntable, the support having at least one track, wherein the turntable is engaged with the at least one track to allow the propulsor to rotate 360 degrees so as to change the propulsion direction.

8. The propulsor of claim 1, wherein the transmission section has an upper limiter and a lower limiter located on the surface of the end that is pivotally connected to the streamline foil, the upper limiter being configured for limiting counterclockwise rotation of the streamline foil and the lower limiter being configured for limiting clockwise rotation of the streamline foil so that the streamline foil rotates within an angle between about +30 degrees and about −30 degrees.

9. The propulsor of claim 8, wherein each of the upper limiter and the lower limiter has a buffer pad for reducing impact on the transmission section caused by heaving motion of the streamline foil.

10. An oscillating-foil type underwater propulsor with a joint used on a man-powered watercraft, the propulsor comprising:

a streamline foil having a foil surface being parallel to a water surface and a span length of at least twice as long as an average chord length of the streamline foil;

a transmission rod having a grip on its top;

a holder being hollow inside and holding the transmission rod in it;

an upper stopper provided at the bottom of the grip to limit downward movement of the transmission rod; and a lower stopper provided on the transmission rod below the holder to limit upward movement of the transmission rod so as to prevent the streamline foil from hitting the hull of the watercraft, wherein the transmission rod is pivotally connected to the streamline foil to form a joint, the joint being provided at the middle of the span length and having a rotation center located within a circular area, which has a radius of one third of the average chord length and is centered at a point one third of the average chord length ahead of a lifting center of the streamline foil.

11. The propulsor of claim 10, wherein the transmission rod has an upper limiter and a lower limiter located on the surface of the end that is pivotally connected to the streamline foil, the upper limiter being configured for limiting counterclockwise rotation of the streamline foil and the lower limiter being configured for limiting clockwise rotation of the streamline foil so that the streamline foil rotates within an angle between about +30 degrees and about −30 degrees.

12. The propulsor of claim 11, wherein each of the upper limiter and the lower limiter has a buffer pad for reducing impact on the transmission rod caused by oscillation of the streamline foil.

13. The propulsor of claim 10, further comprising:

a plurality of rollers provided between the holder and the transmission rod to facilitate reciprocal heaving motion of the transmission rod.

14. The propulsor of claim 10, wherein the transmission rod is capable of rotating 360 degrees so as to change the propulsion direction.

15. The propulsor of claim 10, wherein the streamline foil is made of rigid materials.

* * * * *